US007246935B2

(12) United States Patent
Benghozi et al.

(10) Patent No.: US 7,246,935 B2
(45) Date of Patent: Jul. 24, 2007

(54) TRACK LIGHTING SYSTEM

(75) Inventors: Simon Benghozi, Outremont (CA); Cedric Caloin, Montreal (CA)

(73) Assignee: Bazz Inc. (CA)

( * ) Notice: Subject to any disclaimer, the term of this patent is extended or adjusted under 35 U.S.C. 154(b) by 254 days.

(21) Appl. No.: 11/065,018

(22) Filed: Feb. 24, 2005

(65) Prior Publication Data

US 2005/0207173 A1 Sep. 22, 2005

(51) Int. Cl.
*F21V 21/35* (2006.01)

(52) U.S. Cl. ..... 362/648; 362/655; 362/659; 362/250; 362/147; 362/404; 362/431

(58) Field of Classification Search ..... 362/647–652, 362/655–659, 147, 249–250, 404, 418, 429–431
See application file for complete search history.

(56) References Cited

U.S. PATENT DOCUMENTS 6,135,615 A * 10/2000 Lee ..... 362/648
6,244,733 B1 * 6/2001 Fong et al. ..... 362/391
2004/0005798 A1 1/2004 Lin

FOREIGN PATENT DOCUMENTS

| | | |
|---|---|---|
| DE | 201 17 235 | 1/2002 |
| EP | 0 734 108 | 9/1996 |

* cited by examiner

*Primary Examiner*—Laura Tso
(74) *Attorney, Agent, or Firm*—Akerman Senterfitt

(57) ABSTRACT

A line voltage track light system comprising a number of track elements supported by ceiling feed mounts secured to a ceiling on the one hand, and clipped to the track elements by one-piece adaptors on the other hand, wherein installation of the line voltage track light system comprises securing ceiling feed mounts to a ceiling, and clipping the track elements to one-piece adaptors supported by rods extending from the ceiling feed mounts.

10 Claims, 14 Drawing Sheets

TRACK LIGHTING SYSTEM

CROSS REFERENCE TO RELATED APPLICATIONS

This application claims priority on Canadian application no 2,461,247 filed on Mar. 18, 2004, herein incorporated by reference.

FIELD OF THE INVENTION

The present invention relates to light fixtures. More specifically, the present invention is concerned with a line voltage track lighting system.

SUMMARY OF THE INVENTION

More specifically, there is provided a line voltage (120V–220V) track light system comprising track members securing live and ground wires and supporting light suspensions, the track members being mounted to the ceiling by at least one of anchor posts and feeding mounting posts; the anchor posts being secured on the track members at a first end thereof by a clip on rod with plyer parts free of electrical wire and fastened to the ceiling at a second end thereof, and the feeding mounting posts being secured on the track members at a first end thereof by a mounting adapter and fastened to the ceiling at a second end thereof by a ceiling feed mount; the light suspensions being suspended from the track members by suspension adaptors; wherein the track members are joined together by vertical flush track junctions; and the mounting and suspension adapters are one-piece adaptors comprising a body receiving the wires and a track clipping part receiving the track elements.

Other objects, advantages and features of the present invention will become more apparent upon reading of the following non-restrictive description of embodiments thereof, given by way of example only with reference to the accompanying drawings.

DESCRIPTION OF EMBODIMENTS OF THE INVENTION

Figure 1:
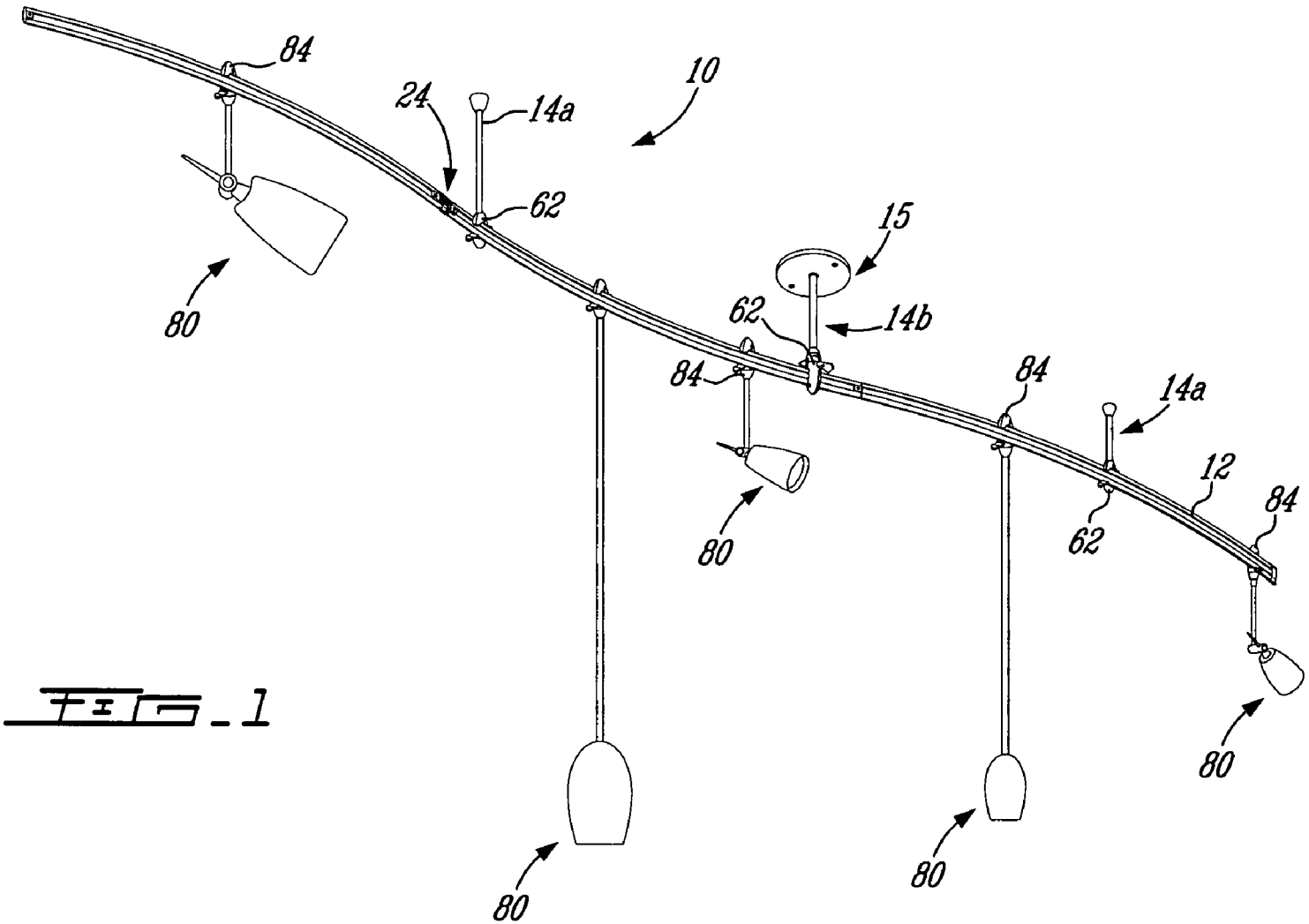
FIG. 1 illustrates a general track lighting system according to an embodiment of the present invention.

As illustrated in FIG. 1, a track lighting system 10 according to an embodiment of the present invention comprises a number of track elements 12 supported by posts 14 secured to a ceiling (not shown).

Figure 2:
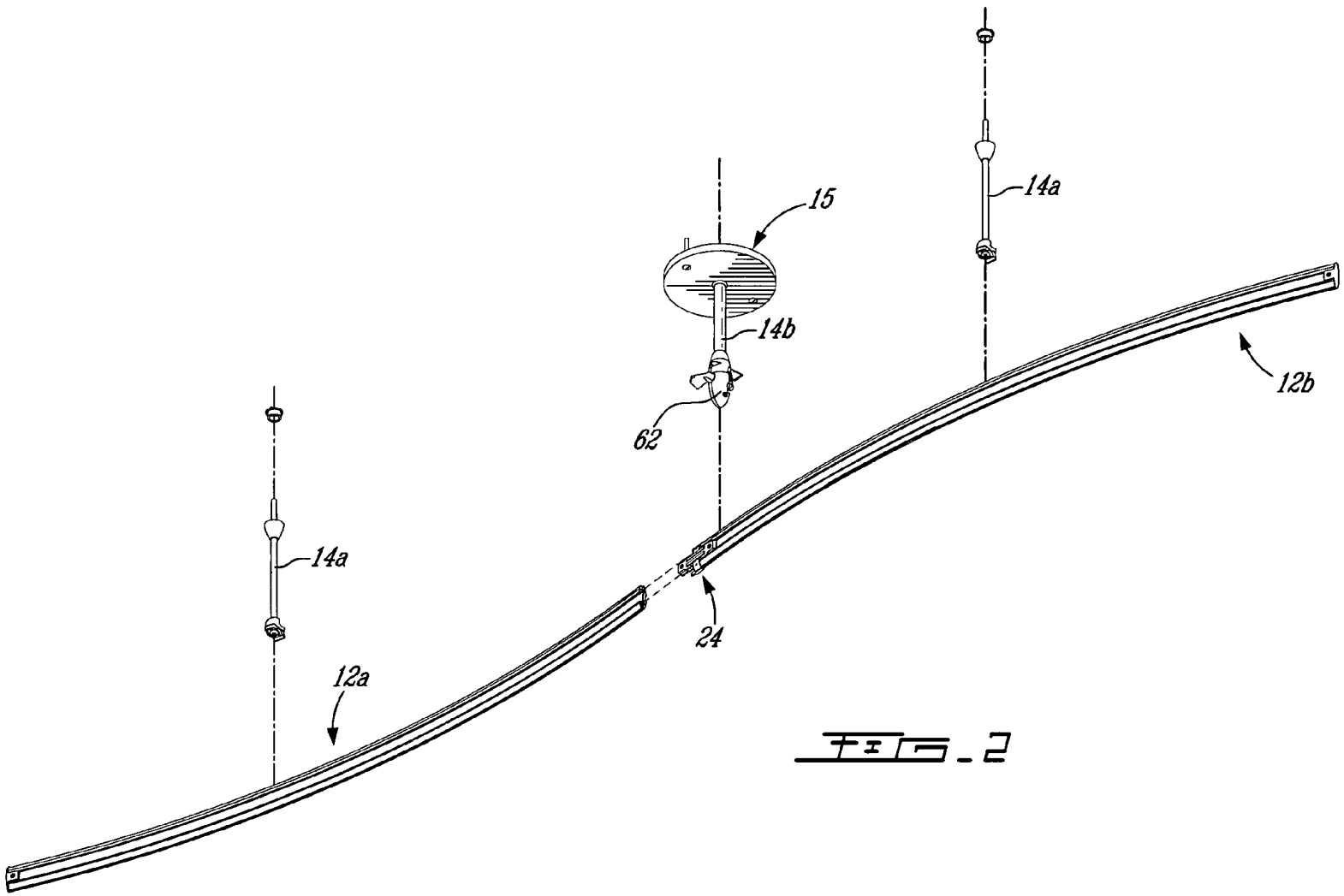
FIG. 2 illustrates sections of track members used in the system of FIG. 1.

The track elements 12 may be linear or may include curvilinear sections. FIG. 2, for example, illustrates a right-bended track element 12*a* and a left-bended track element 12*b*.

Figure 3:
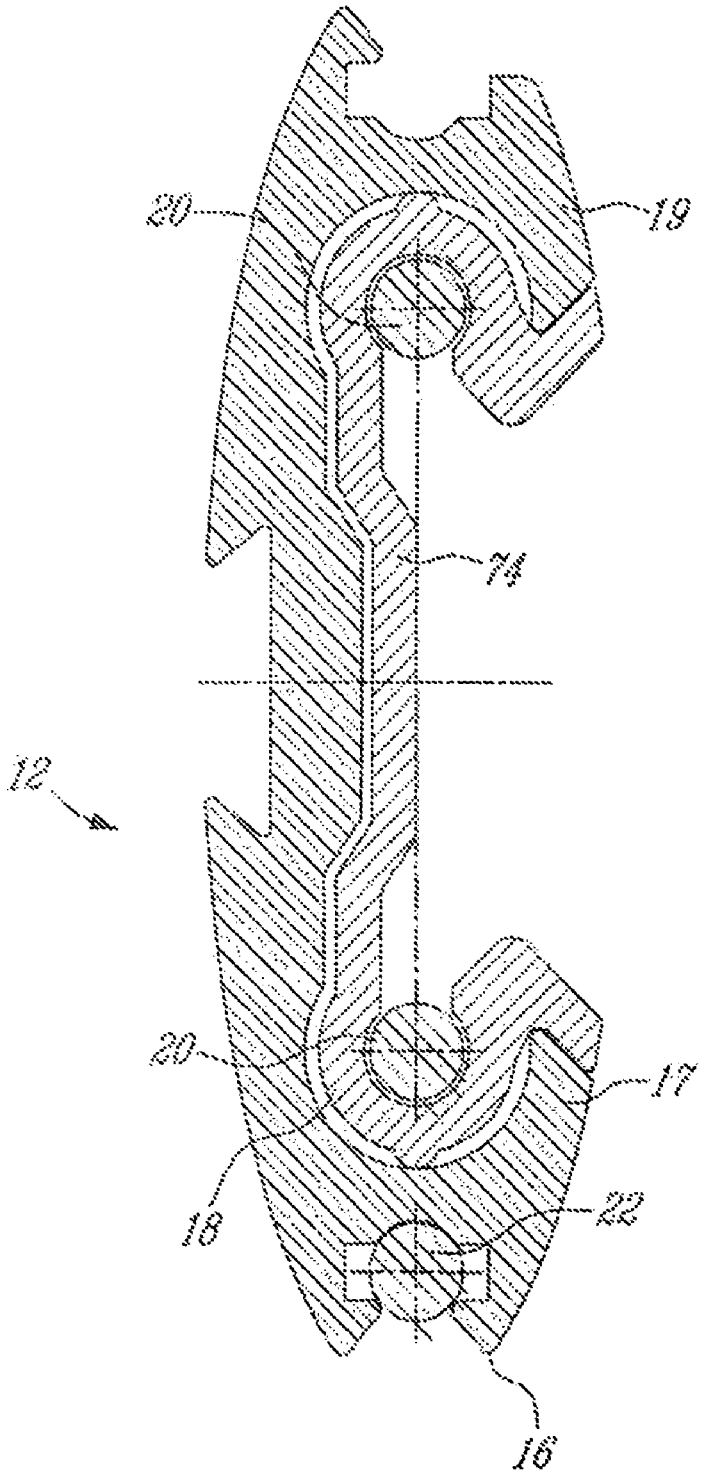
FIG. 3 is a cross-section of a track member used in the system of FIG. 1.

As shown in the cross-section of FIG. 3, the track element 12 comprises a vertical rail-type body extrusion 16 wrapped around an insulation extrusion 18, which secures live wires 20 located on a vertical axis relative to the ceiling (not shown). A ground wire 22 is secured into a groove of the body extrusion 16.

The vertical body extrusion 16 may be made in aluminum, the insulation extrusion 18 may be made in PVC, and the wires 20 and 22 are copper wires for example.

Figure 4:
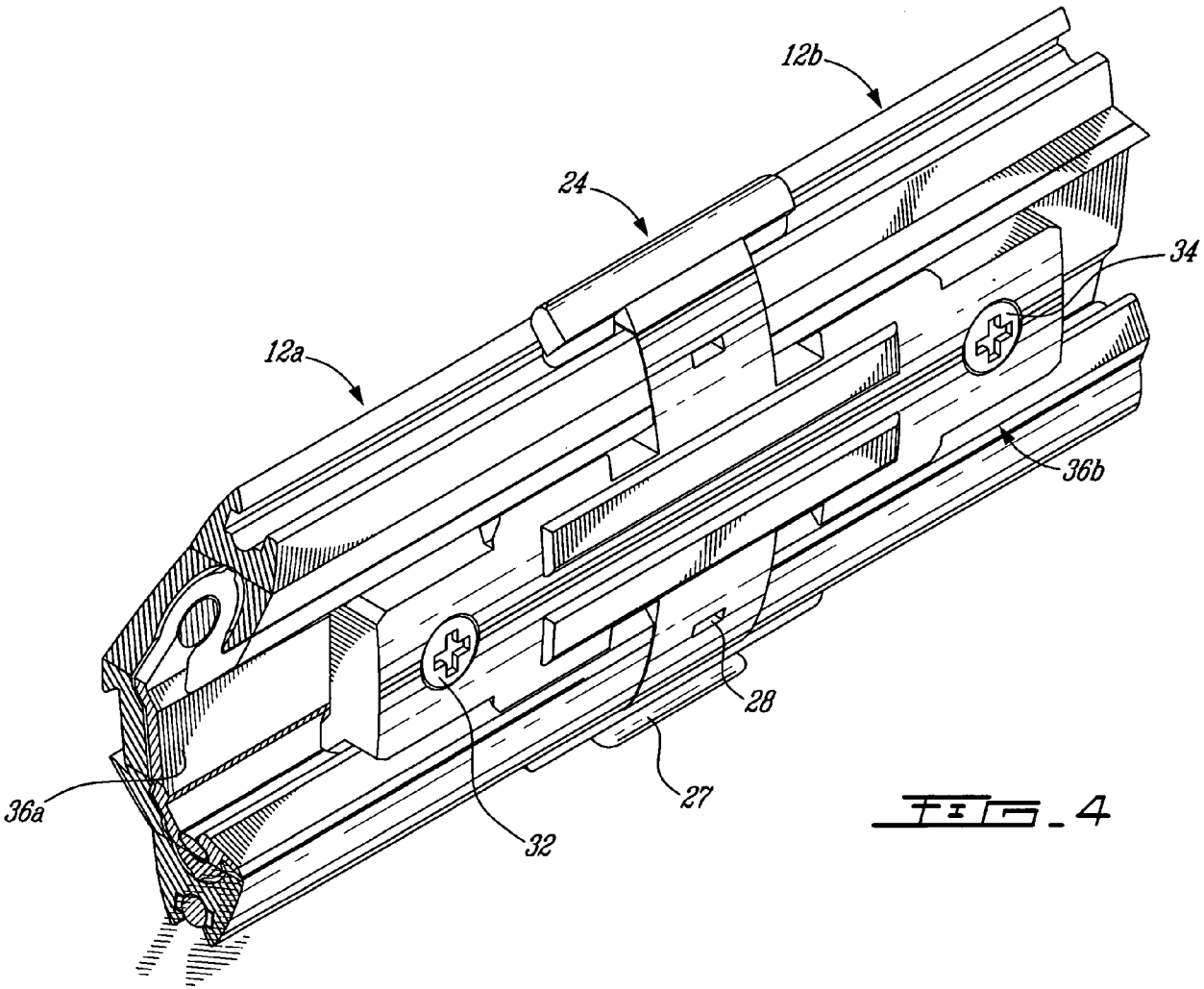
FIG. 4 is a front view of a junction between tracks elements of the system of FIG. 1.
Figure 5:
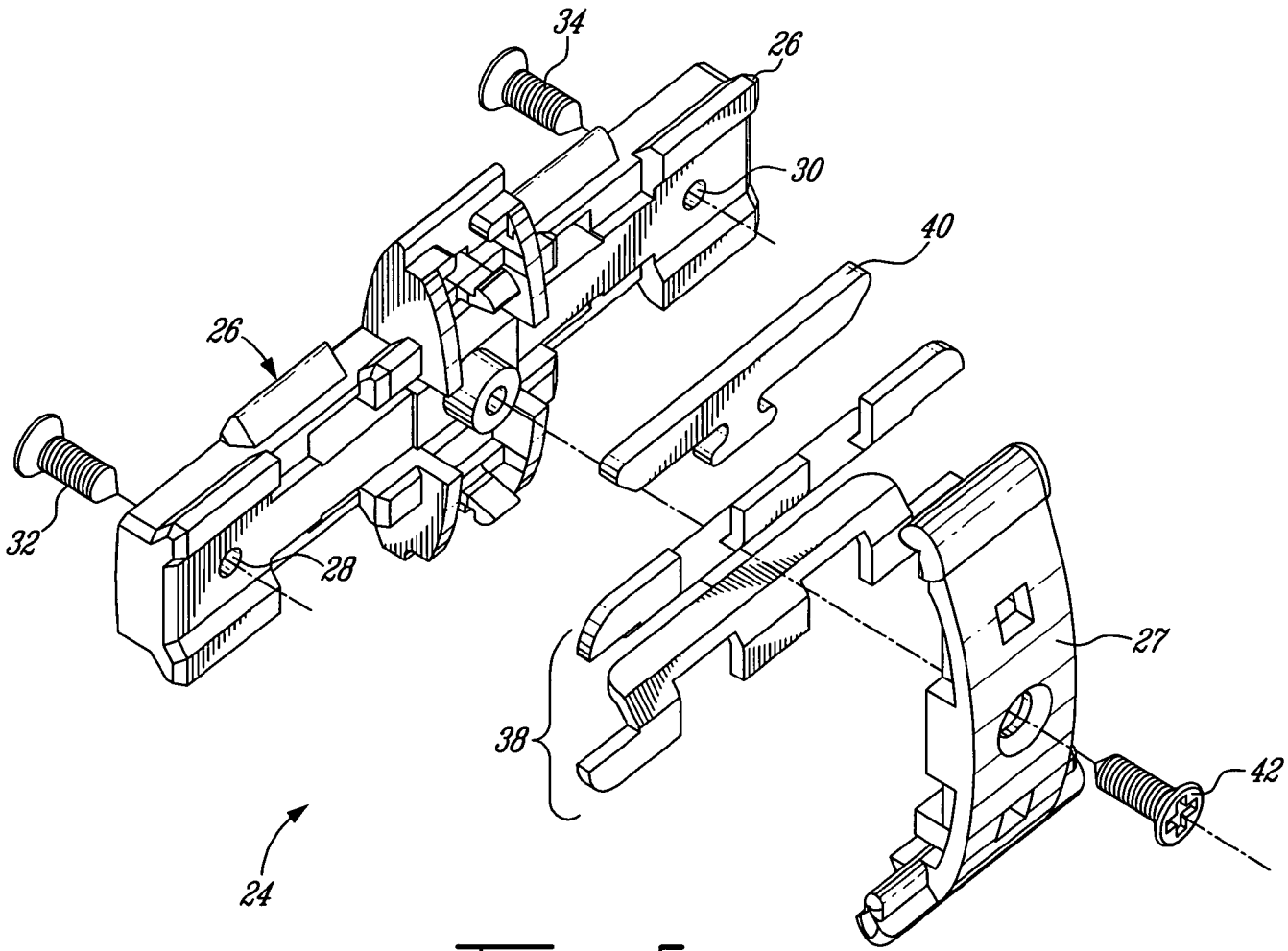
FIG. 5 is an exploded view of the junction of FIG. 4.

Track elements 12 are assembled together by vertical flush track junctions 24 shown in FIGS. 4 and 5.

As seen in FIG. 4, a vertical track junction 24 comprises a junction body 26 with a first and a second fastening apertures 28 and 30 on each wing thereof. The junction body 26 has a shape matching an interior female shape of the insulation extrusion 18 of the track elements 12: the first wing of the junction body 26 with the first fastening aperture 28 comes into place within an interior 36*a* of the insulation extrusion of a first track element 12*a*, and the second wing with the second fastening aperture 30 comes into place within an interior 36*b* of the insulation extrusion of a second track element 12*b* (see FIG. 4).

Each one of the track elements 12*a* and 12*b* comprises fastening apertures corresponding to the fastening aperture 28 and 30 of the junction body 26 respectively, allowing using fastening means such as screws 32 and 34 to secure the junction body 26 to the track elements 12*a* and 12*b* respectively.

When thus lapped between the track elements 12*a* and 12*b*, the junction body 26 receives a shell cover 27, further bridging the two joined track elements 12*a* and 12*b* together on an opposite side thereof. The shell cover 27 further holds into place a live junction clip 38 and a junction ground clip 40. The shell cover 27 may be secured by means of a pressure screw 42 for example (see FIG. 5).

The track members thus joined together form a track member assembly, which is secured to the ceiling by the posts 14, located at intervals along a length thereof. At least part of the posts 14 are anchor posts 14*a*, while other are feeding mounting posts 14*b*, as will now be described.

As illustrated in FIG. 10, an anchor post 14*a* comprises a member 122 having a dimension between a first end 124 for fixing to the ceiling and a second end 126 for fastening to the track member assembly. The member 122 may be of an adjustable length between these two ends, so as to allow selecting a height of suspension of the track member assembly.

The first end 124 comprises a ceiling cone 128 receiving a lock screw 130 for a ceiling support screw 132 mounted into the ceiling through a ceiling support 134. The ceiling cone 128 and the ceiling support 134 may be made in a plastic material such as ABS for example. A further anchor between the ceiling and a hollow panel may be used to ease fixing the screw 132.

The second end 126 for fastening to the track member assembly comprises a clip on rod with plyer parts 138 without any electrical wire therein.

Figure 10A:
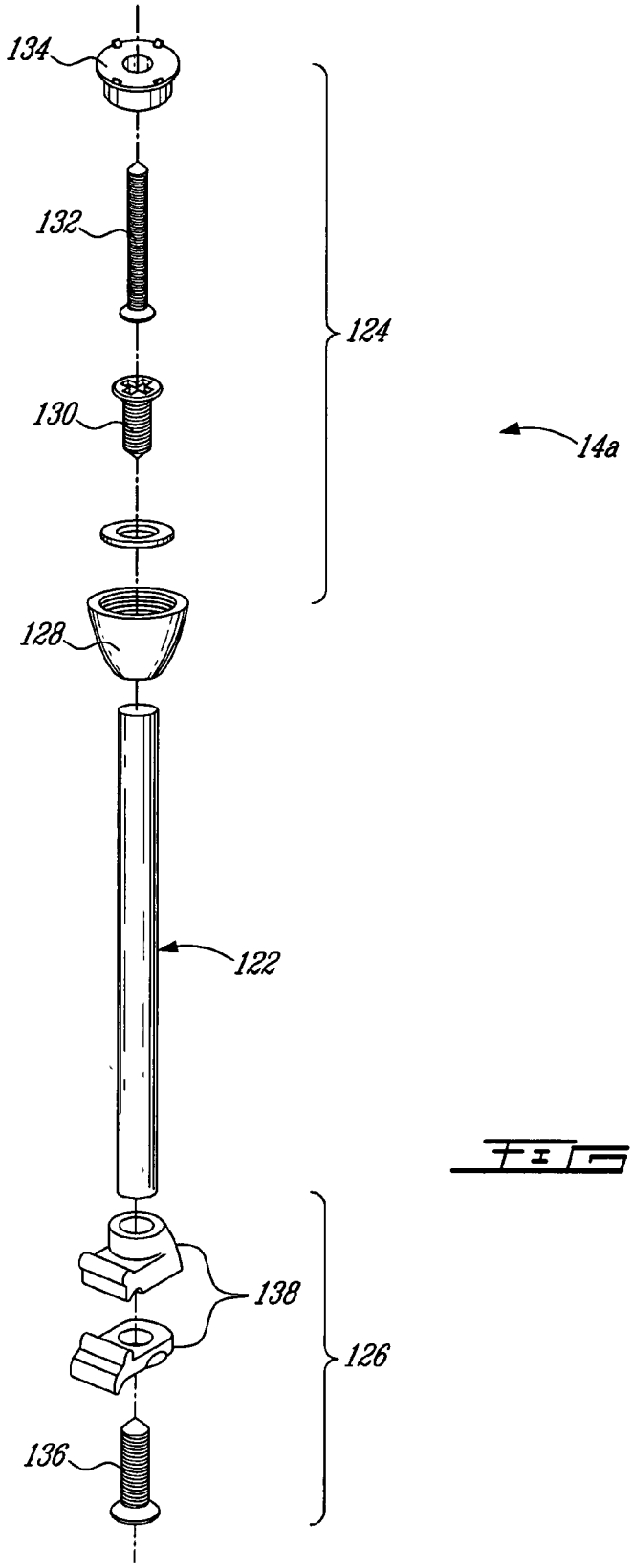
FIG. 10(A) illustrates an anchor post used to secure the system of FIG. 1 to the ceiling, and FIG. 10(B–D) illustrate a method for mounting a track element to an anchor post.
Figure 10D:
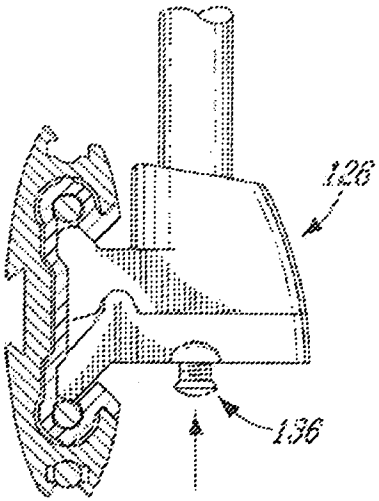
Figure 10C:
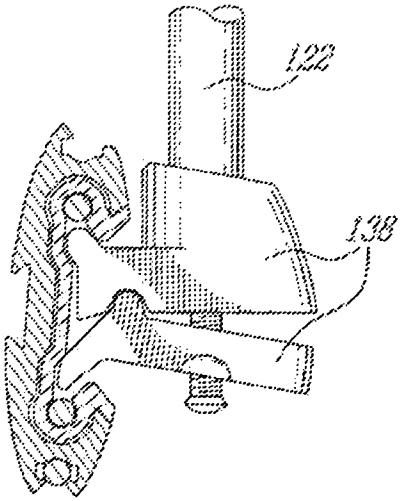
Figure 10B:
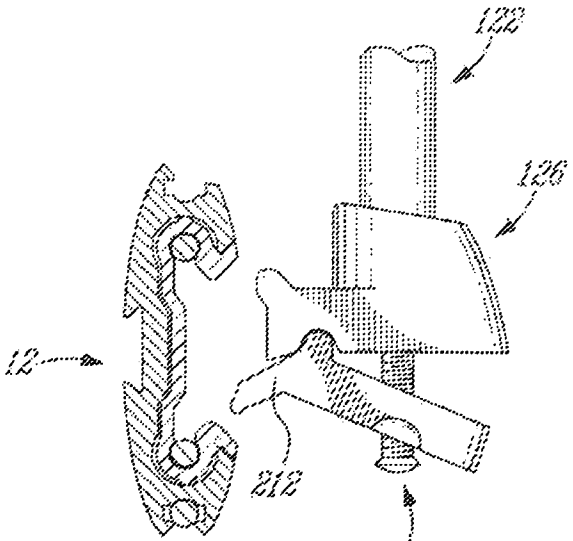

As best seen in FIG. 10B–10D, for securing a track member 12, a lower clipping part 212 of the clip on rod is inserted in the female part of the track element 12, both having complementary shapes. The lower clipping part 212 automatically engages the female part of the track element 210. Adjustment of a lock screw 136 allows further securing the clip on rod to the track element 12.

Figure 6:
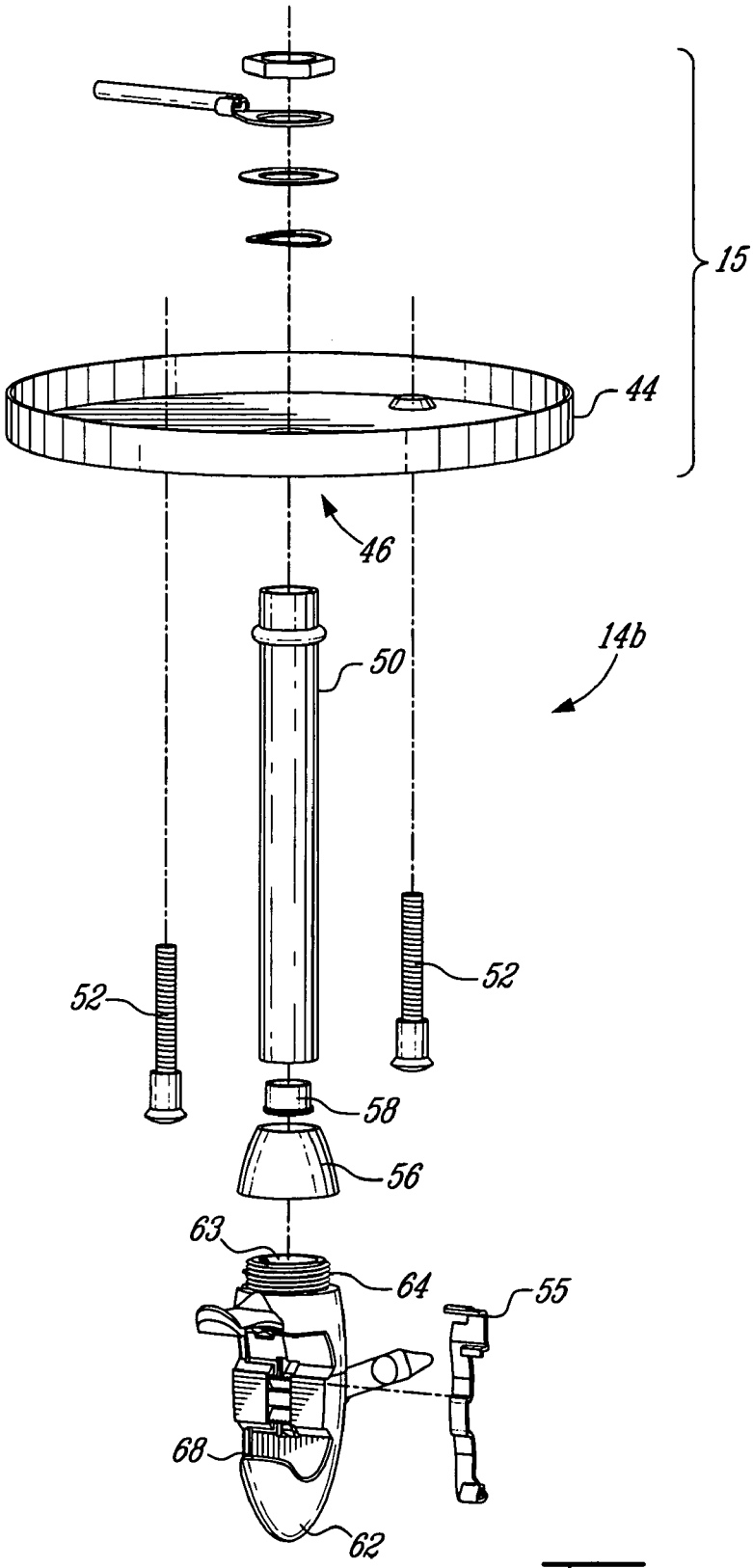
FIG. 6 is an exploded perspective view of a feeding mounting post used in the system of FIG. 1.

The feeding mounting posts 14*b* are mounted to the ceiling by ceiling-feed mounts 15, as now described in relation to FIG. 6.

The ceiling feed mount 15 comprises a canopy 44 having a passageway 46 for a wire (not shown). The canopy 44 is secured to the ceiling, or to a generally horizontal surface for example, by means of fastening means 52 such as stud screws.

As shown in FIG. 6, the wire may be protected within a tube 50, which may be threadedly secured on a top part thereof to the passageway 46 of the canopy 44 and threadedly secured to the junction cone 56 via a bushing 58 for example. A length of the tube may be adjusted depending on a desired height of suspension, and, correspondingly, a clip, such as a plastic ABS clip may be used to allow adjusting a length of the wire 48 inside the member 122.

Figure 7A:
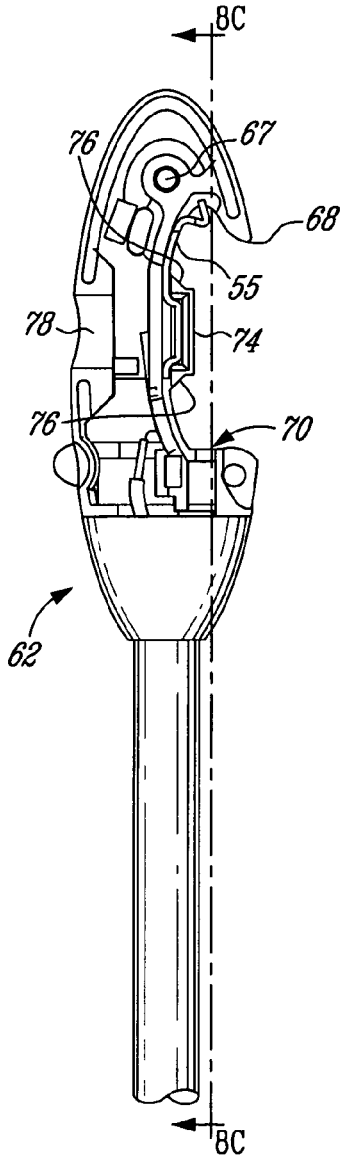
FIG. 7 show views of a suspension adaptor used in the system of FIG. 1.
Figure 7B:
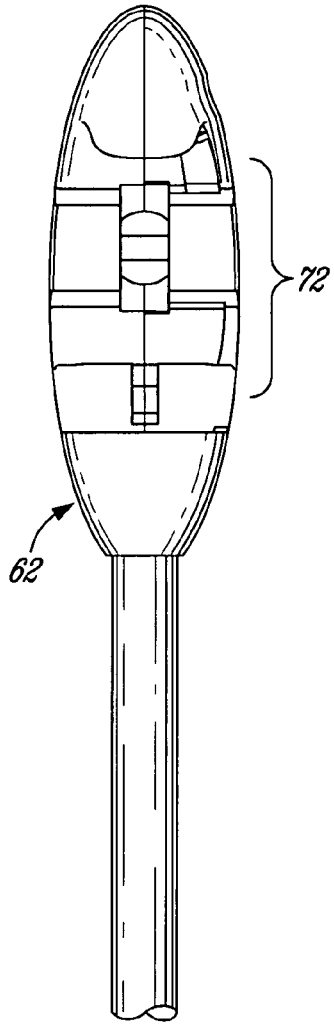
Figure 7C:
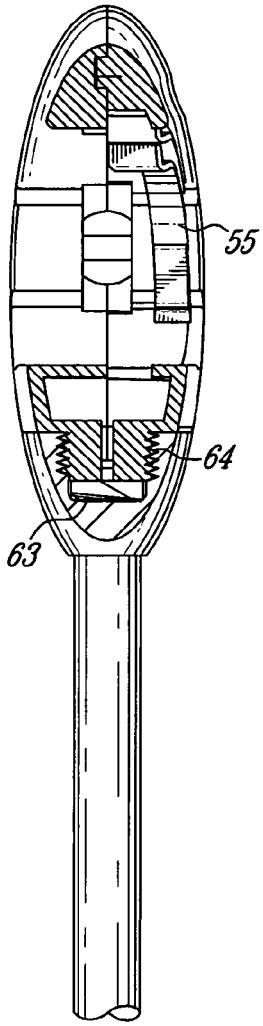

The junction cone 56 allows a junction to the one-piece mounting adaptor 62, which will be described in details in relation to FIGS. 3 and 6–7.

The one-piece mounting adaptor 62 comprises a body receiving the wire 48, a junction part 64 comprising an aperture 63 for connection to the wire 48 coming from the ceiling feed mount 15, and a track clipping part 72.

The track clipping part 72 receives the rail-type body extrusion 16 of a track element between a crook-like edge 68, which comes into a locking position on a first lip 17 of the rail-type body extrusion 16 (see FIG. 3) and a flange portion 70, which comes in abutment and is clipped by pressure on a clipping element 71 with a second lip 19 of the rail-type body extrusion 16 (see FIG. 3), so that the track clipping part 72 of the mounting adapter 62 comes in contact with the interior surface of the insulation extrusion of the track element. A ground link clip 67 is provided inside the crook-like edge 68 (see FIG. 7A).

The flange portion 70 may further comprise a locket tongue 73 (see FIGS. 11 and 12), which flips back on the second lip 19 of the rail-type body extrusion 16 and locks itself into a groove 77 provided on a back face of the rail-type body extrusion 16, in such a way as to secure the mounting adapter 62 onto the rail-type body extrusion 16.

The track clipping part 72 of the mounting adaptor 62 (see FIG. 7) has a shape complementary to that of the interior female surface of the insulation extrusion of the track element, a prominent surface 74 of the track clipping part 72 corresponding to a recessing surface of the interior female surface of the insulation extrusion of the track element (see FIG. 3).

Retractable tongues 76 are provided in a recess of the prominent surface 74 of the track clipping part 72. These tongues may be moved in a connecting position or in a disconnecting position by an action of an arm 78. In the connecting position, the tongues 76 extend out of the prominent surface 74 of the track clipping part 72 so as to establish an electrical contact with the live wires 20 nested in the insulation extrusion of the track element. In a disconnecting position, the tongues 76 recoil in the recess of the prominent surface 74, thereby disconnecting the wires of the track element.

Figure 8:
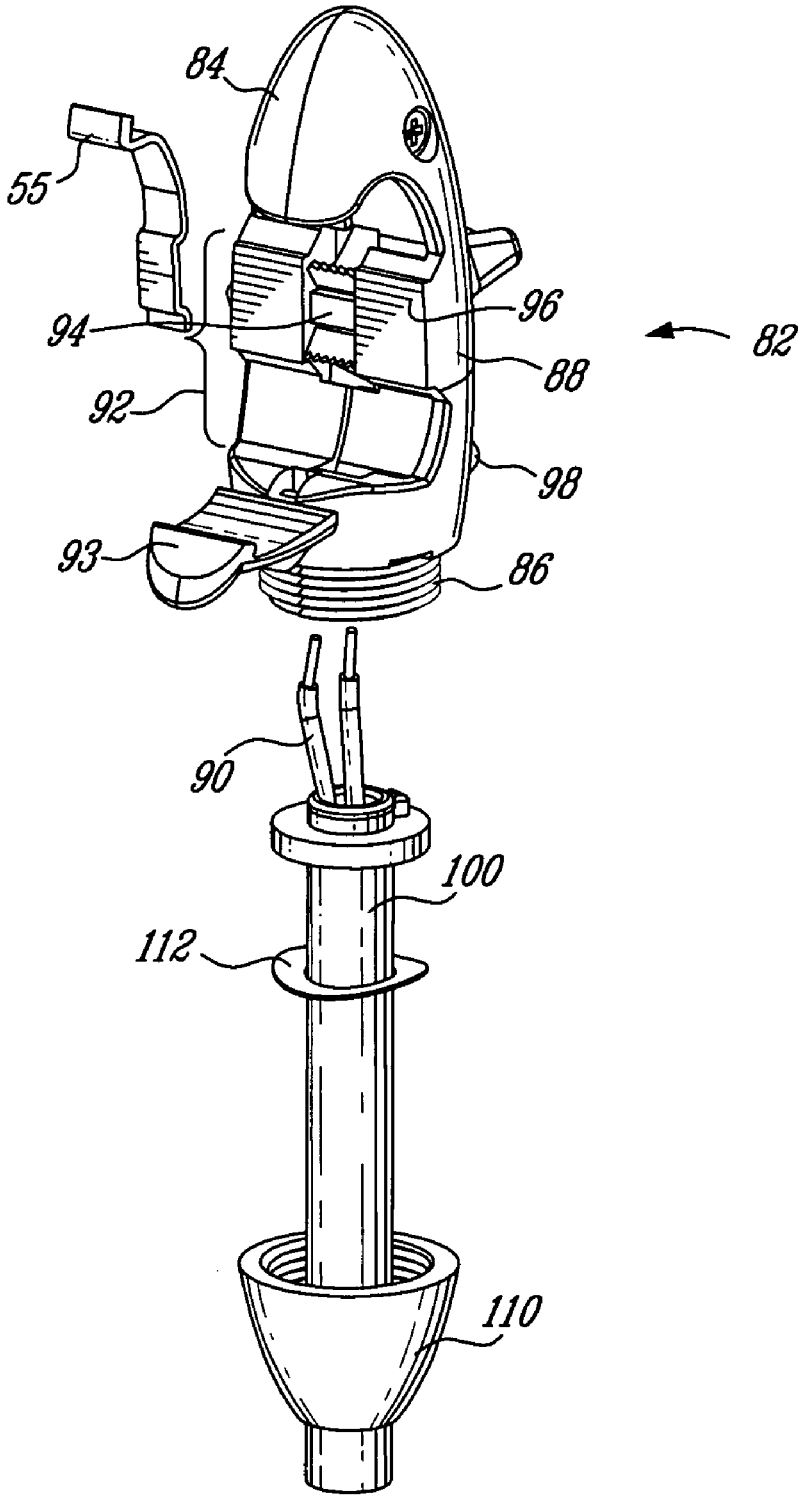
FIG. 8 is a perspective view of a mounting adapter used in the system of FIG. 1.

As may be seen in FIG. 1, a number of lighting devices such as spots or pendants 80 may be suspended along a length of the track system 10, by using suspensions 82 as illustrated in FIG. 8.

The suspension 82 comprises a suspension adapter 84 between the track member assembly and the lighting device (not shown in FIG. 8).

Figure 11:
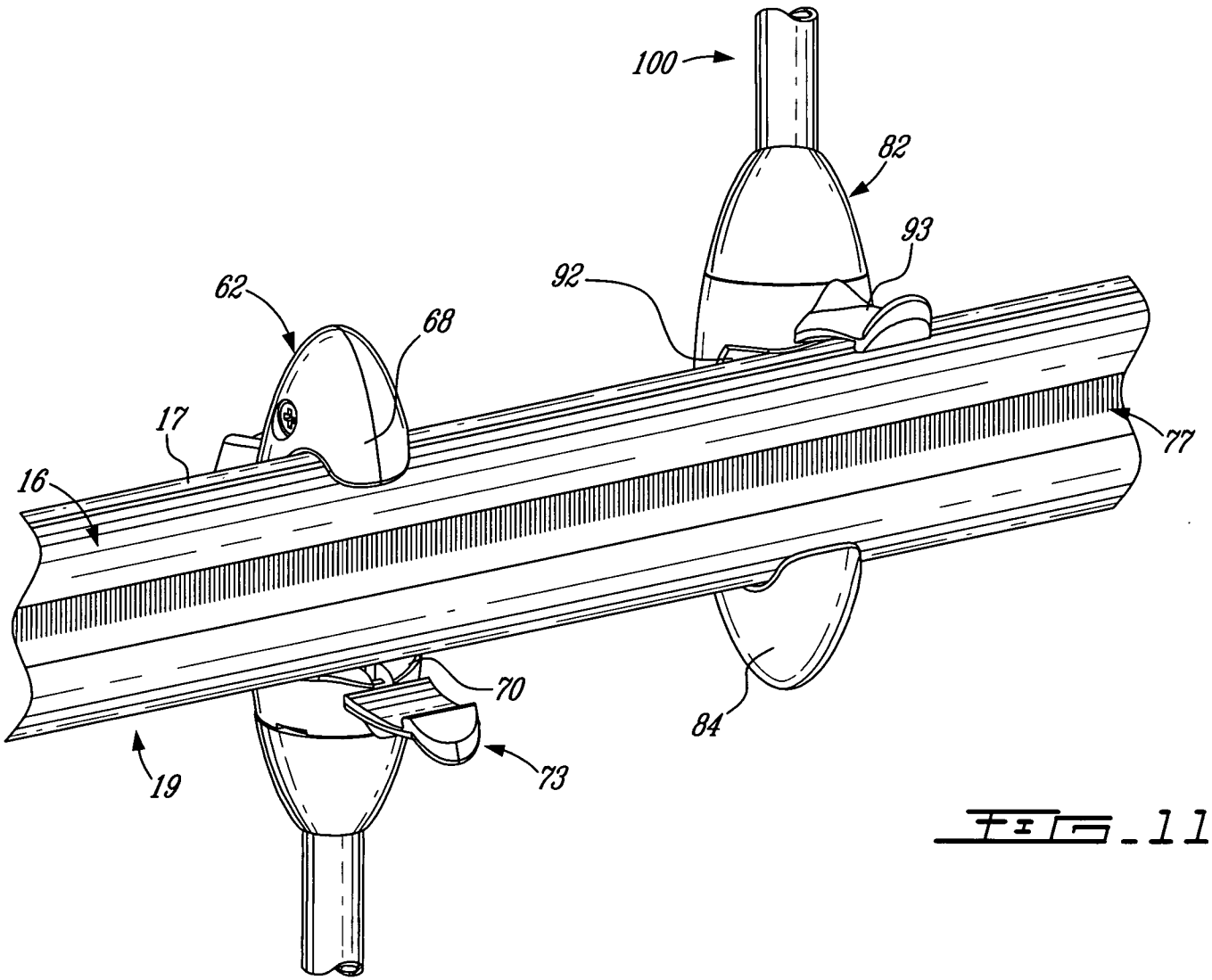
FIG. 11 illustrates a suspension adaptor and a mounting adapter clipped to a track element of the system of FIG. 1.
Figure 12:
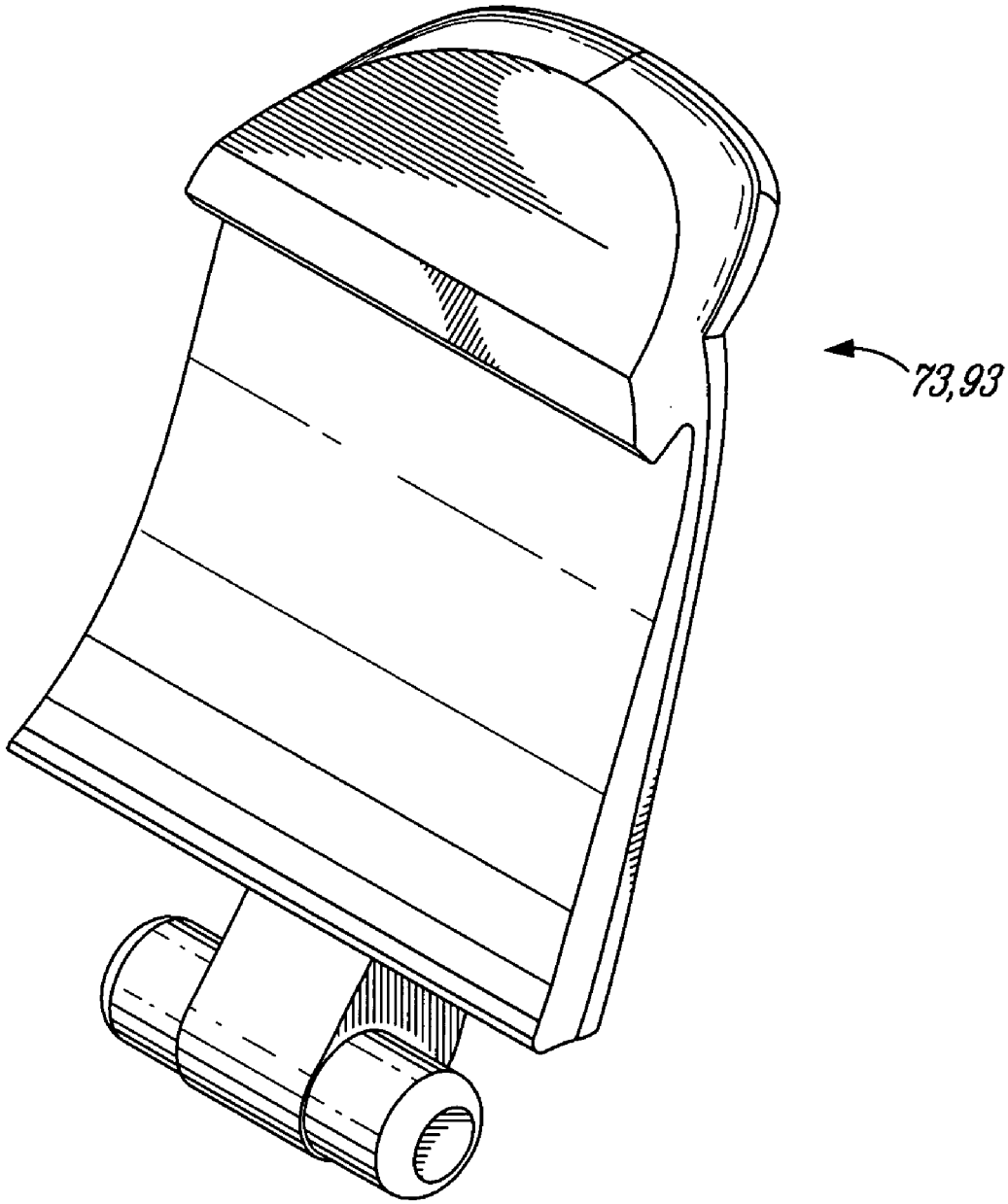
FIG. 12 illustrates a locking clip for securing an adaptor to a track member according to the present invention.

As seen in FIG. 11, the suspension adaptor 84 is essentially identical to the mounting adaptor 62 between the ceiling feed mounts 14 and the track described hereinabove. The suspension adaptor 84 comprises a junction part 86, a body part 88 receiving a wire 90 going to the lighting device to be suspended, and a track clipping part 92. The track clipping part 92 clips the rail-type body extrusion 16 of the track element in the same way as described hereinabove in relation to the mounting adaptor 62.

Tongues 94 are provided in a recess of a surface 96 of the track clipping part 92. These tongues may be moved into a connecting position and into a disconnecting position by an action of a swindle arm 98. In the connecting position, the tongues 94 extend out of the surface 96 of the track clipping part 92 and establish an electrical contact with the wires in the body 88 of the suspension adaptor 84, whereas in the disconnecting position, the tongues 94 are retracted inside the body part 88 of the suspension adaptor 84, thereby disconnecting the wires of the track element.

Figure 9A:
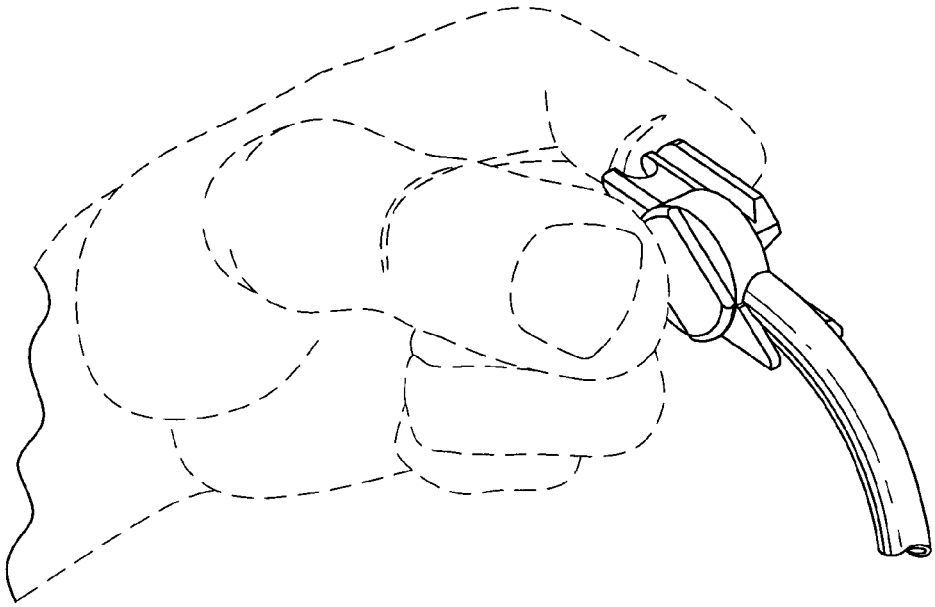
FIG. 9 illustrate a clip for adjusting a length of the wire for hanging a lighting device.
Figure 9B:
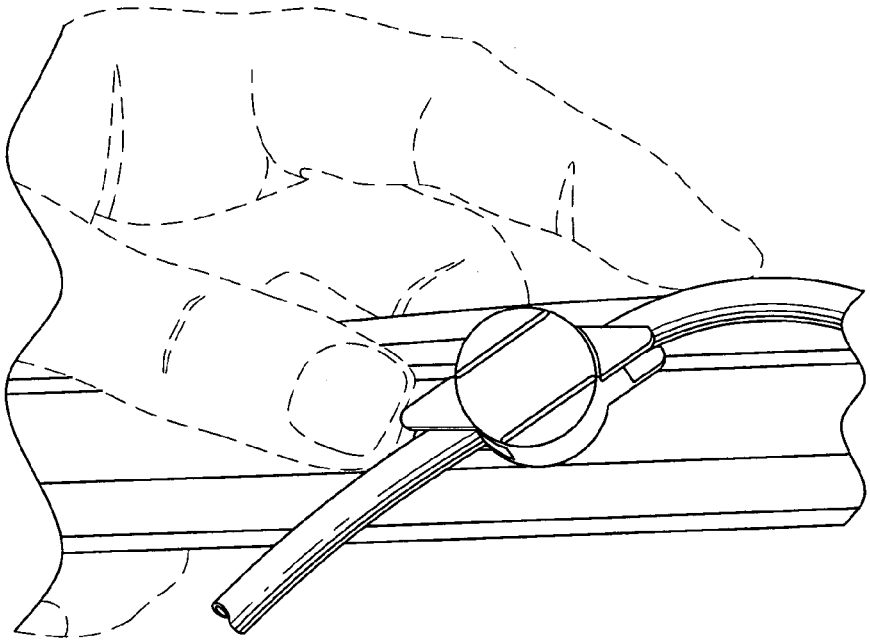
Figure 9C:
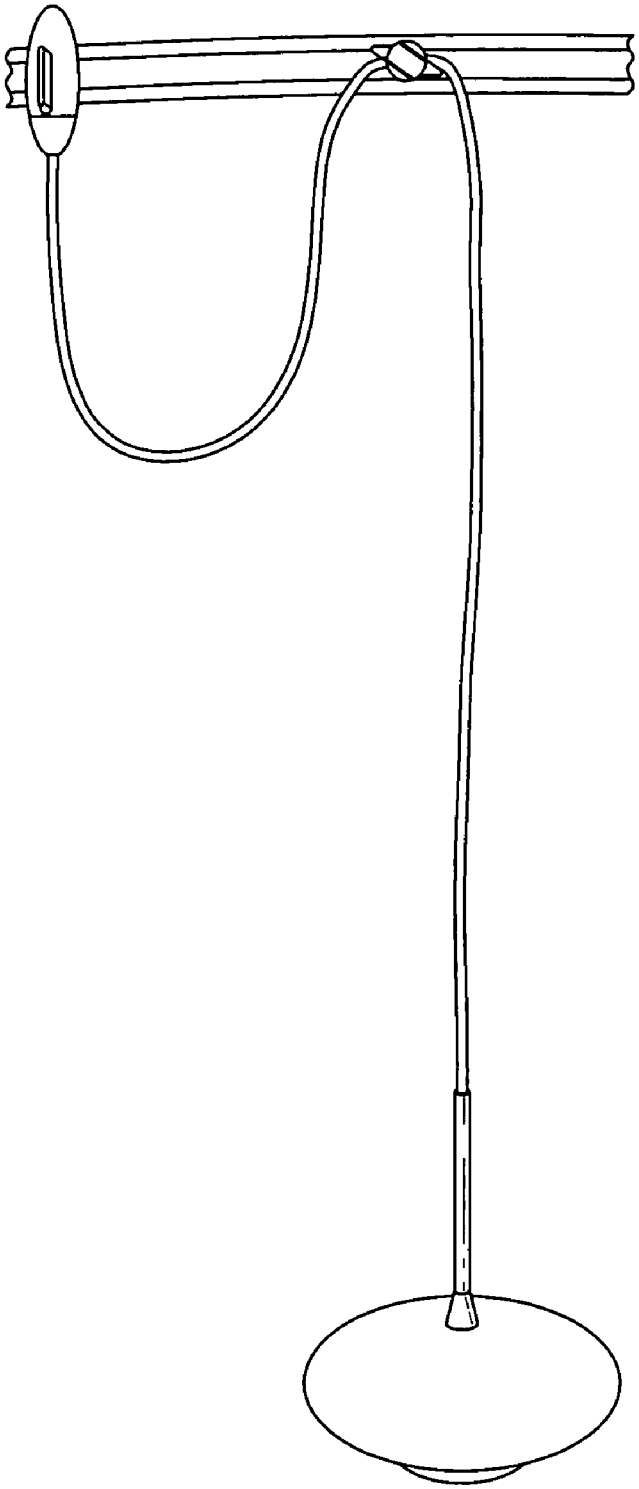

The suspension 84 adaptors may comprise a locket tongue 93, which flips back and locks itself into a median groove provided on a back surface of the rail-type body extrusion of the track member, in such a way as to secure the suspension adapter 84 onto the rail-type body extrusion. The wires 90 may be protected within a tube 100, which may be threadedly secured on a top part thereof to a passageway of the suspension adaptor 84 via a junction cone 110 and washers 112 for example, and on a bottom part thereof to the desired lighting device, as is well known in the art. A clip, made in BAS for example, for adjusting a length of the wire 90 may be used to adjust a height of suspension of the lighting device (not shown), as shown in FIG. 9.

Locating pins 55 matching the profile of the track elements 12 (see FIGS. 6, 7, 8) may be used for preventing any wrong installation of a mounting adaptor 62 or of a suspension adaptor 84 on the tracks described hereinbefore, so as to respect the electric polarity and allow a correct grounding, for example.

From the foregoing, it should now be apparent that the present invention provides a versatile line voltage track (120–220V) light system allowing hanging up easily lighting devices such as spots or pendants, by essentially one type of one-piece adaptor between the track and a wire-containing element.

Although the present invention has been described hereinabove by way of embodiments thereof, it may be modified, without departing from the nature and teachings of the subject invention as defined in the appended claims.

The invention claimed is:

1. A line voltage (120V–220V) track light system comprising track members securing live and ground wires and supporting light suspensions, the track members being mounted to the ceiling by at least one feeding mounting post and one anchor post; the anchor post being secured on the track members at a first end thereof by a clip on rod with plyer parts free of electrical wire and fastened to the ceiling at a second end thereof, and the at least one feeding mounting post being secured on the track members at a first end thereof by a mounting adapter and fastened to the ceiling at a second end thereof by a ceiling feed mount; the light suspensions being suspended from the track members by suspension adaptors;

wherein said track members are joined together by flush track junctions; and said mounting and suspension adapters are one-piece adaptors comprising a body receiving the wires and a track clipping part receiving the track elements.

2. The line voltage track light system according to claim 1, wherein said track clipping part of the adaptors comprises retractable tongues connected to the wires nested in the track elements, said tongues being movable between a connecting position and a disconnecting position, whereby, in the connecting position, the tongues establish an electrical contact with the wires nested in the track elements, and in the disconnecting position, the tongues disconnect the wires of the track elements.

3. The line voltage track light system according to claim 1, wherein said anchor posts have an adjustable length between the first and second ends thereof, said second end thereof comprising a ceiling cone receiving a lock screw for a ceiling support screw mounted into the ceiling through a ceiling support.

4. The line voltage track light system according to claim 1, wherein a lower clipping part of said clip on rod is inserted in a female part of the track elements, a lock screw allowing further securing the clip on rod to the track elements.

5. The line voltage track light system according to claim 1, wherein locating pins matching a profile of the track elements are provided for ensuring proper installation of the mounting adaptors and of the suspension adaptors on the tracks, in terms of electric polarity and correct grounding.

6. The line voltage track light system according to claim 1, wherein said adaptors further comprise a locket tongue on a flange portion thereof, said locket tongue flipping back in a locking engagement with a groove provided on a back face of a body of the track members.

7. The line voltage track light system according to claim 1, wherein said track members each comprise a vertical rail-type body extrusion wrapped around an insulation extrusion, said track members being located along a generally vertical axis relative to the ceiling.

8. The line voltage track light system according to claim 7, wherein said body extrusion is made in aluminum and said insulation extrusion is made in PVC.

9. The line voltage track light system according to claim 7, wherein said track junctions comprise a junction body and a shell cover, said junction body having a shape matching an interior shape of said insulation extrusion of the track elements, said junction body joining a first and a second track members, said shell cover bridging any gap between the two joined track elements.

10. The line voltage track light system according to claim 1, wherein said at least one feeding mounting post comprises a canopy having a passageway for a wire, said canopy being secured to the ceiling, said wire connected on an opposite end thereof to the mounting adapter by a junction cone.

* * * * *